United States Patent [19]

Willeitner

[11] 4,111,123

[45] Sep. 5, 1978

[54] BENDING-RESISTANT GRIPPER CARRIAGE SUPPORT STRUCTURE, PARTICULARLY FOR OFFSET PRINTING MACHINES

[75] Inventor: Eberhard Willeitner, Utting am Ammersee, Germany

[73] Assignee: Maschinenfabrik Augsburg-Nurnberg Aktiengesellschaft, Germany

[21] Appl. No.: 770,019

[22] Filed: Feb. 18, 1977

[30] Foreign Application Priority Data

Feb. 18, 1976 [DE] Fed. Rep. of Germany ..... 2606345
Feb. 18, 1976 [DE] Fed. Rep. of Germany ..... 2606346

[51] Int. Cl.[2] ..... B41F 21/04
[52] U.S. Cl. ..... 101/407 A; 271/277; 271/82
[58] Field of Search ..... 101/407 R, 408, 409, 101/230–232; 271/82, 85, 277, 204, 268

[56] References Cited

U.S. PATENT DOCUMENTS

| | | | |
|---|---|---|---|
| 2,436,765 | 2/1948 | Davidson et al. | 101/409 |
| 2,767,653 | 10/1956 | Babicz | 101/409 |
| 2,776,136 | 1/1957 | Dietrich | 101/408 |
| 3,935,814 | 2/1976 | Weisgerber | 101/409 |
| 3,937,142 | 2/1976 | Cerny et al. | 101/409 |
| 3,958,507 | 5/1976 | Mitter | 101/407 R |
| 4,029,009 | 6/1977 | Kuhn et al. | 101/409 |

FOREIGN PATENT DOCUMENTS

| | | | |
|---|---|---|---|
| 539,406 | 11/1931 | Fed. Rep. of Germany | 101/408 |

*Primary Examiner*—William Pieprz
*Attorney, Agent, or Firm*—Craig & Antonelli

[57] ABSTRACT

A bending-resistant gripper carriage support structure for offset printing machines is constructed of at least one hollow profiled member. In particular, one arrangement includes two hollow profiled members being connected by the bearing blocks of the gripper shaft for mounting the gripper carriage in the printing machine. A further arrangement includes the use of a single hollow profiled member for the gripper carriage support with an internally disposed web structure for subdividing the single profiled member.

14 Claims, 4 Drawing Figures

BENDING-RESISTANT GRIPPER CARRIAGE SUPPORT STRUCTURE, PARTICULARLY FOR OFFSET PRINTING MACHINES

The present invention concerns a bending-resistant gripper carriage, particularly for offset printing machines, with structural elements of hollow profiled members. In particular, at least one hollow profiled member is employed for a gripper carriage support in the present invention.

Gripper devices in printing machines have been previously contemplated, for example, in U.S. Pat. Nos. 2,882,049; 2,436,765; 2,974,572; 604,004; 2,405,868; and 2,551,060; as well as German Offenlegungsschrift 2,140,442, in which the necessary portions are incorporated herein to show the state of the prior art. However, gripper carriages for offset printing machines are subject to rather great deformations with increasing printing speeds, thereby resulting in a mutual shifting of the dots which form the printed picture. The concomitant shifting of the color shade of the printed product is, of course, rather disadvantageous and undesirable.

The deformation of the gripper carriages occurring at higher printing speeds results from the centrifugal force which is a necessary result of the predetermined curves through which the carriage travels. During this travel, the gripper carriages are under the force of a load resulting from the product of its own weight times the acceleration of the carriage. As such, this load is a linear load.

In general, the equation of a bending curve for a gripper carriage support under linear load reveals that the flexure is smaller, when the expression $(E/\gamma) \cdot I_b$ is large. In this connection, $(E/\gamma)$ represents the specific modulus of elasticity, and $I_b$ represents the area moment of inertia.

These values can be influenced by constructional measures, such as considered in the concurrently filed U.S. patent application, Ser. No. 770,020, filed Feb. 18, 1977, having common inventors, and assigned to the same Assignee as the present application.

The present invention resides in a solution to the problems arising in offset printing machines by providing a novel construction for bending-resistant gripper carriage structures, wherein the specific modulus of elasticity, as well as the area moment of inertia, are substantially increased without having to increase simultaneously the weight of such structures, thereby making it possible at the same time to obtain an increase in the printing speeds than are presently customary.

Thus, a bending-resistant gripper carriage structure is provided in accordance with one embodiment of the present invention in which the gripper carriage support is constructed of two respectively inherently closed, unperforated hollow profiled members. These profiled members are connected with each other by way of bearing blocks equipped with bearings for a gripper shaft for mounting the gripper carriage support structure in the offset printing machines.

End plates may be provided in opposing correspondence to the respective narrow end faces of the connected hollow profiled members. These end plates may be connected to the hollow profiled members either by pins, screws, or welding.

The bearing blocks for the gripper shaft may be releasably connected to the profiled members.

According to another aspect of this construction, the hollow profiled members may be fashioned as extruded profiled members particularly of a lightweight metal.

However, it is also possible to provide the hollow profiled members in the form of correspondingly cast members. In this case, a continuous casting method can be preferably employed to produce hollow profiled structures.

A further embodiment of the present invention resides in a gripper carriage support being a single, inherently closed, unperforated hollow profiled member with one of the outer longitudinal sides thereof being equipped with the bearing blocks having bearings for the gripper shaft in the offset printing machine.

Preferably, the hollow profiled member constituting the gripper carriage support in this embodiment has a central longitudinal web.

As above, end plates may be arranged in opposing correspondence to the respective narrow end faces of the hollow profiled member. These end plates also may be connected to the profiled member by pins, screws, or by means of welding. Furthermore, the bearing blocks for the gripper shaft may be releasably connected to the hollow profiled member.

The single hollow profiled member may also be fashioned as an extruded profiled member, especially of a lightweight metal, such as, for example, an extruded aluminum profiled member. Moreover, the hollow profiled member may be produced in the form of an appropriately welded construction.

However, it is also possible to construct the hollow profiled member for the gripper carriage support by a corresponding cast construction, such as preferably a continuous casting method.

These and other objects, features, and advantages of the present invention will become more apparent from the following description when taken in connection with the accompanying drawings which show, for purposes of illustration only, two embodiments in accordance with the present invention, and wherein.

Figure 1:
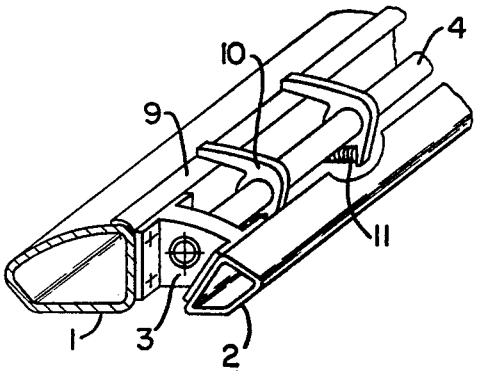
FIG. 1 shows a gripper carriage support in a perspective, cross-sectional view.
Figure 2:
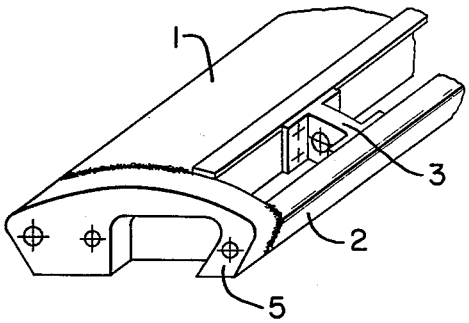
FIG. 2 is a perspective end view of the gripper carriage according to FIG. 1.

The gripper carriage illustrated in FIGS. 1 and 2 is intended for use in an offset printing machine, and comprises a gripper carriage support having two structural elements, each being fashioned respectively as inherently closed, unperforated hollow profiled members 1 and 2. These hollow profiled members have varying cross-sections and profiled configurations, and are in each case shaped so that, after assembly together thereof, a gripper carriage support is constructed with its total cross-section corresponding to the customary configuration for gripper devices.

The hollow profiled members 1 and 2 may consist, for example, of extruded profiled members of a lightweight metal, e.g. aluminum.

For mutual connection of the two hollow profiled members 1 and 2, bearing blocks 3 are provided containing the bearings for a gripper shaft 4, wherein the latter extends in the lontitudinal direction of the gripper carriage support and is arranged substantially in the zone between the two hollow profiled members 1 and 2. A number of movable brackets 10 are mounted on the gripper shaft 4, wherein these brackets cooperate with springs 11.

On the topside of the left-hand profiled member 1 having the larger cross-section, an impact strip 9 is arranged, on which the curved ends of the brackets 10 rest and terminate in a point. As can be seen from FIG. 1, the bearings for the gripper shaft 4 are an integral part of the bearing blocks 3.

FIG. 2 shows that the gripper carriage is closed off at each end face by an end plate 5, which is arranged in opposition to the narrow end face of the two profiled members 1 and 2 and covers them completely. The end plates 5, located at each end of the gripper carriage support, may be connected to the profiled members 1 and 2 by means of pins, screws, and also by means of welding. Furthermore, the bearing blocks 3 are each releasably connected with the profiled members 1 and 2, thereby facilitating assembly, adjustment, and repair.

From the construction of gripper carriage structures in accordance with this embodiment of the invention, a substantially increased area moment of inertia $I_b$ is achieved, thereby resulting in high bending resistance, so that gripper carriages constructed in accordance with the invention can withstand increased centrifugal loads without suffering excessive deformations. Accordingly, it is possible to utilize higher printing speeds in offset printing machines.

Figure 3:
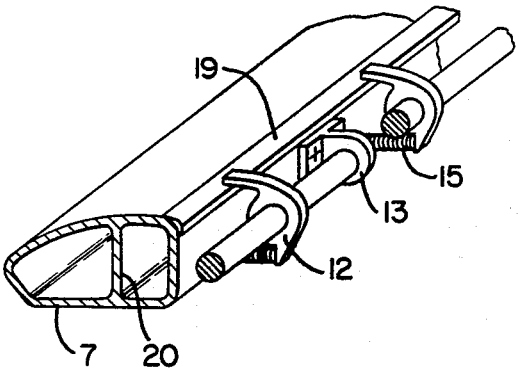
FIG. 3 shows a perspective view of another embodiment for a gripper carriage support in cross-section.
Figure 4:
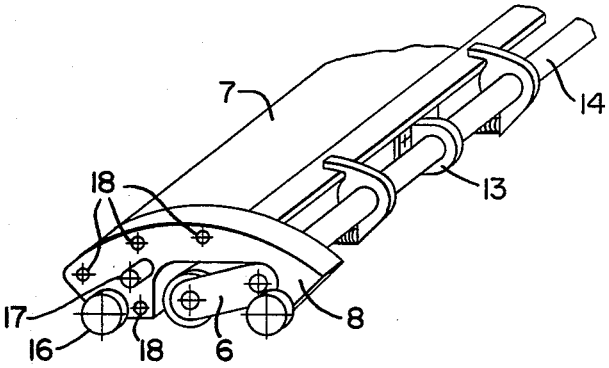
FIG. 4 shows an end view of the gripper carriage according to FIG. 3, likewise in perspective.

In another embodiment for a gripper carriage in an offset printing machine as illustrated in FIGS. 3 and 4, only a single, inherently closed and unperforated hollow profiled member 7 is provided as the gripper carriage support. The bending-resistant structure of this gripper carriage support is additionally improved by constructing the hollow profiled member 7 with a central longitudinal web 20 which practically divides this profiled member into two partial hollow profiled portions. The profiled member 7 is made, for example, in the form of an extruded profiled member of a lightweight metal, e.g. aluminum.

However, the extruded profiled member of this embodiment may also be replaced by a correspondingly welded construction, or by a cast construction.

Along a longitudinal side of the hollow profiled member 7, bearing blocks 13 are attached in each case on the outside of the member 7. These bearing blocks contain the bearings for the gripper shaft 14. Brackets 12 are mounted on the gripper shaft 14, and cooperate with springs 15. The curved upper ends of the brackets 12, which terminate in a point, rest on an impact strip 19 attached to the topside of the profiled member 7.

As can be seen from FIG. 4, the gripper carriage also has end plates 8 at the respective end faces, and are connected to the hollow profiled member 7 preferably by welding or by a screw connection 18.

Furthermore, drag lever 6, a trunion 17, and a guide roller 16 are arranged respectively at the end plates 8. These components serve to accommodate guiding and transporting by the rotating gripper carriage.

In addition, in the gripper carriage structure illustrated in FIGS. 3 and 4, the bearing blocks 13 for the gripper shaft 14 may be releasably connected to the hollow profiled member 7 for assembly, adjustment, and possible repair purposes.

Because of this construction for gripper carriage structures in accordance with this embodiment of the present invention, a substantially increased area moment of inertia $I_b$ is achieved, so that with gripper carriages constructed according to this embodiment, a high bending resistance is ensured to withstand increased centrifugal loads without suffering excessive deformations. This makes it possible to utilize higher printing speeds for operation of offset printing machines.

A further advantage of this latter construction may be achieved by filling the hollow profiled member 7 with a foam material. Such foam materials are conventionally known, as for example, polyurethane, or polystyrene, and afford a higher torsional strength or stiffness to the gripper carriage structure. Further, damping of any possible vibrations may be provided.

As noted above, the present invention provides a significantly improved, practical, and efficient gripper carriage structure, particularly for use in high speed operation of offset printing machines. As such, both the above-described embodiments of the present invention may be utilized in an offset printing machine, wherein the gripper carriage structure may be connected to an endless chain of the offset printing machine. In such use, the gripper carriage structure according to the present invention serves as a means to transport sheets to be printed on from one printing roller to another printing roller, or to another gripper carriage structure which conveys the sheet to a subsequent printing roller. In addition, the gripper carriage structure in accordance with each of the above-described embodiments of the present invention may serve to convey sheets from a table to the first station of the printing machine, or from the last station of the machine to a storage device. Moreover, the embodiments of the gripper carriage structure of the present invention may be used for conveying sheets to and from shearing presses for cutting the sheets to size.

While I have shown and described two embodiments in accordance with the present invention, it is understood that the same is not limited thereto but is susceptible of numerous changes and modifications as known to a person skilled in the art, and I therefore do not wish to be limited to the details shown and described herein but intend to cover all such changes and modifications as are obvious to one of ordinary skill in the art.

What I claim is:

1. A bending-resistant gripper carriage arrangement for offset printing machines which, in order to increase the area moment of inertia and provide a high bending resistance, comprises at least one one-piece closed unperforated hollow profile member, a gripper shaft supported by said profile member, and gripping brackets carried by said gripper shaft for movement between a sheet gripping and a sheet releasing position, said profiled member being hollow throughout its length and having a continuous, smooth, curved, upper, outer sheet receiving surface extending for the entire length of the profiled member and wherein said gripping brackets grip a sheet between said brackets and said upper outer sheet receiving surface of the profile member in said sheet gripping position.

2. A gripper carriage arrangement according to claim 1, wherein said arrangement is constructed so as to be connected to an endless chain of an offset printing machine for transporting sheets from a first location to a second location.

3. Gripper carriage arrangement according to claim 1, characterized in that two respectively inherently closed, unperforated profiled members are provided; and that these profiled members are connected with each other by way of bearing block means equipped with bearings for a gripper shaft means.

4. Gripper carriage arrangement according to claim 3, characterized in that end plate means are provided respectively in opposition to the narrow end faces of the profiled members.

5. Gripper carriage arrangement according to claim 4, characterized in that the end plate means are connected with the profiled members by means of pins.

6. Gripper carriage arrangement according to claim 4, characterized in that the end plate means are connected with the profiled members by means of screws.

7. Gripper carriage arrangement according to claim 4, characterized in that the end plate means are connected with the profiled members by means of welding.

8. Gripper carriage arrangement according to claim 3, characterized in that the bearing block means are in each case releasably connected with the profiled members.

9. Gripper carriage arrangement according to claim 3, characterized in that the profiled members are fashioned as extruded profiled members, especially of a lightweight metal.

10. Gripper carriage arrangement according to claim 3, characterized in that the profiled members are formed by welded constructions.

11. Gripper carriage arrangement according to claim 3, characterized in that the profiled members are fashioned by cast constructions.

12. Gripper carriage arrangement according to claim 11, characterized in that profiled member constructions made by a continuous casting method are utilized.

13. Gripper carriage arrangement according to claim 1, characterized in that the profiled member has a central longitudinal web means.

14. Gripper carriage arrangement according to claim 1, characterized in that the inherently closed, unperforated profiled member is filled with foam material.

* * * * *